United States Patent [19]

Maninger et al.

[11] Patent Number: 5,010,271

[45] Date of Patent: Apr. 23, 1991

[54] COLOR PICTURE TUBE HAVING AN ELECTRON GUN WITH REDUCED CONVERGENCE DRIFT

[75] Inventors: Loren L. Maninger; Bruce G. Marks, both of Lancaster, Pa.

[73] Assignee: RCA Licensing Corporation, Princeton, N.J.

[21] Appl. No.: 427,230

[22] Filed: Oct. 24, 1989

[51] Int. Cl.[5] ..... H01J 29/50; H01J 29/51

[52] U.S. Cl. ..... 313/412; 313/414

[58] Field of Search ..... 313/414, 417, 412

[56] References Cited

U.S. PATENT DOCUMENTS

| | | | |
|---|---|---|---|
| 4,119,884 | 10/1978 | Blumenberg et al. | 313/414 X |
| 4,492,894 | 1/1985 | Reule et al. | 313/414 |
| 4,546,287 | 10/1985 | Collins et al. | 313/414 |
| 4,631,442 | 12/1986 | Reule et al. | 313/414 |
| 4,697,120 | 9/1987 | Alig et al. | 313/412 |
| 4,743,796 | 5/1988 | Baudry et al. | 313/414 |
| 4,772,826 | 9/1988 | Bloom et al. | 313/414 |
| 4,897,575 | 1/1990 | Shimoma et al. | 313/414 X |
| 4,940,917 | 7/1990 | Stil | 313/414 |

FOREIGN PATENT DOCUMENTS 1108683 9/1981 Canada .

*Primary Examiner*—Palmer C. DeMeo

*Attorney, Agent, or Firm*—Joseph S. Tripoli; Dennis H. Irlbeck

[57] ABSTRACT

A color picture tube includes a screen and an improved inline gun for generating and directing three inline electron beams along separate paths toward the screen. The gun includes a plurality of cathodes and at least six electrodes longitudinally spaced from the cathodes. The improvement comprises the first, second and fourth electrodes from the cathodes being of materials having lower coefficients of thermal expansion than the coefficients of thermal expansion of the materials of the other electrodes.

10 Claims, 10 Drawing Sheets

12
16
18
10
P
24
14
28
A
A
100
26
30
22
P
20

COLOR PICTURE TUBE HAVING AN ELECTRON GUN WITH REDUCED CONVERGENCE DRIFT

This invention relates to color picture tubes having multibeam electron guns and, particularly, to an improvement in such guns to reduce the convergence drift of the electron beams during tube warmup.

BACKGROUND OF THE INVENTION

The most common multibeam electron gun presently used in color picture tubes is the inline electron gun. An inline electron gun is one designed to generate or initiate preferably three electron beams in a common plane and direct those beams along convergent paths in that plane, to a point or small area of convergence at the tube screen.

Most inline electron guns attain static convergence of the undeflected electron beams by slightly distorting the focus fields at the outer beams, so that the outer beams are deflected toward the center beam to effect convergence of the beams at the screen. One means of distorting the focus fields is to offset one aperture in a focus electrode from its associated aperture in a facing focus electrode. A given static convergence at the screen of a tube is established by a particular combination of aperture offsets throughout the gun and beam position in the main lens. A problem, encountered in color picture tubes having built-in static convergence, is convergence drift during tube warm-up. Convergence drift is caused by a change of beam position in the main lens due to a relative change of horizontal aperture positions of all the electrodes throughout the electron gun. The relative aperture motion is due to different thermal expansions of the different grids caused by a temperature gradient from the cathode to the main lens. The convergence drift problem has been approached previously by tailoring the coefficient of expansion of each electrode, to match the thermal gradient, to keep constant the relative horizontal positions of all apertures throughout the gun. Such a modified electron gun is disclosed in U.S. Pat. No. 4,631,442, issued to Reule et al. on Dec. 23, 1986.

As part of the present invention, it first was determined that simply matching the coefficients of expansion of the electrodes to the thermal gradient in an electron gun does not always provide the desired reduction in convergence drift. Instead, it was determined that a more detailed analysis of the gun structure can be used to attain an even greater reduction in convergence drift.

SUMMARY OF THE INVENTION

A color picture tube includes a screen and an improved inline gun for generating and directing three inline electron beams along separate paths toward the screen. The gun includes a plurality of cathodes and at least six electrodes longitudinally spaced from the cathodes. The improvement comprises the first, second and fourth electrodes from the cathodes being of materials having lower coefficients of thermal expansion than the coefficients of thermal expansion of the materials of the other electrodes.

DETAILED DESCRIPTION OF THE PREFERRED EMBODIMENT

Figure 1:
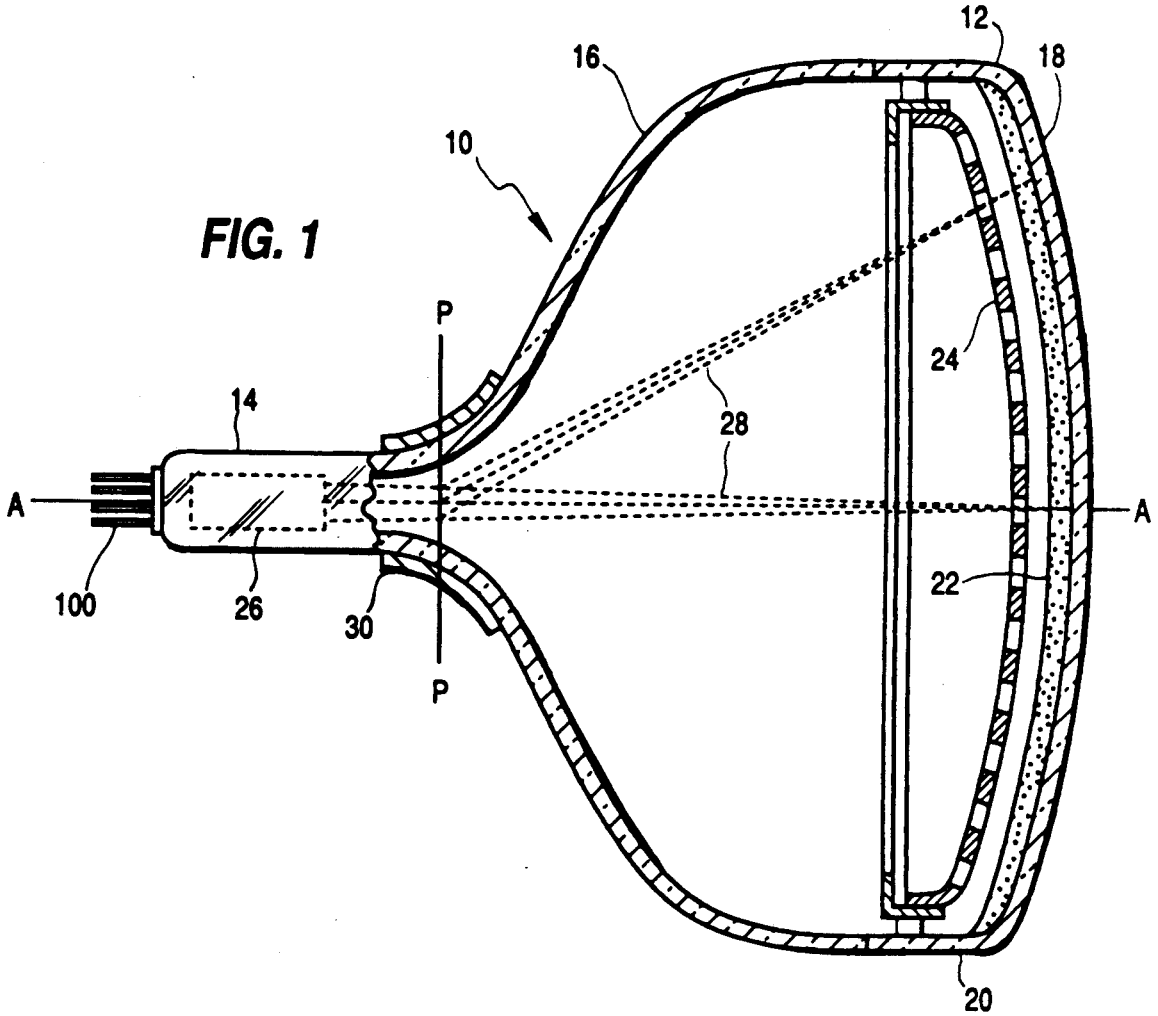
FIG. 1 is a plan view, partly in axial section, of a shadow mask color picture tube embodying the invention.

FIG. 1 is a plan view of a rectangular color picture tube 10 having a glass envelope comprising a rectangular faceplate panel or cap 12 and a tubular neck 14 connected by a rectangular funnel 16. The panel comprises a viewing faceplate 18 and a peripheral flange or sidewall 20 which is sealed to the funnel 16. A three-color phosphor screen 22 is carried by the inner surface of the faceplate 18. The screen is preferably a line screen, with the phosphor lines extending substantially perpendicular to the high-frequency raster line scan of the tube (normal to the plane of FIG. 1). A multi-apertured color-selection electrode or shadow mask 24 is removably mounted in predetermined spaced relation to the screen 22. An improved inline electron gun 26, shown schematically by dotted lines in FIG. 1, is centrally mounted within the neck 14, to generate and direct three electron beams 28 along coplanar convergent paths through the mask 24 to the screen 22.

The tube of FIG. 1 is designed to be used with an external magnetic deflection yoke, such as the self-converging yoke 30 shown surrounding the neck 14 and funnel 12 in the neighborhood of their junction. When activated, the yoke 30 subjects the three beams 28 to vertical and horizontal magnetic flux which cause the beams to scan horizontally and vertically, respectively, in a rectangular raster over the screen 22. The initial plane of deflection (at zero deflection) is shown by the line P-P in FIG. 1 at about the middle of the yoke 30. Because of fringe fields, the zone of deflection of the tube extends axially, from the yoke 30 into the region of the electron gun 26. For simplicity, the actual curvature of the deflected beam paths in the deflection zone is not shown in FIG. 1.

Figure 2:
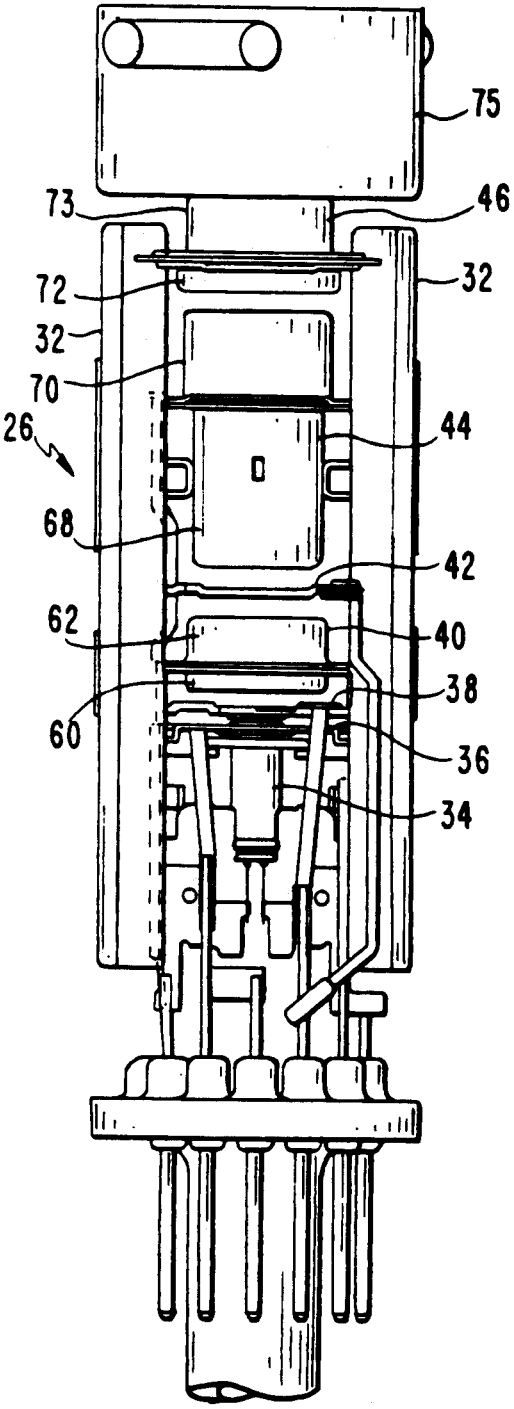
FIG. 2 is a side view of the electron gun shown in dashed lines in FIG. 1.
Figure 3:
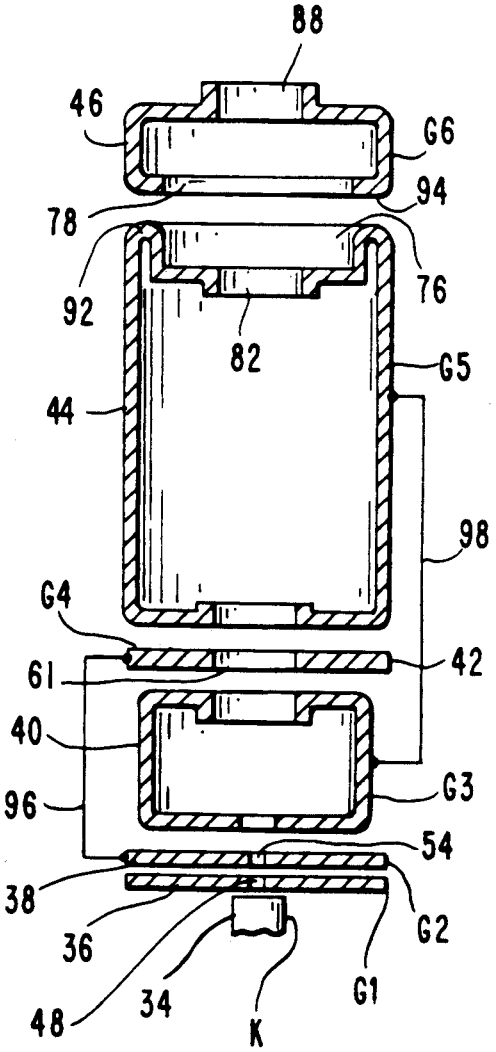
FIG. 3 is an axial section view of a simplified version of the electron gun shown in FIG. 2.

The details of the electron gun 26 are shown in FIGS. 2 and 3. The electron gun comprises two glass supports rods 32 on which various electrodes are mounted. These electrodes include three equally spaced coplanar cathodes 34 (one for each beam), a G1 grid electrode 36, a G2 grid electrode 38, a G3 electrode 40, a G4 electrode 42, a G5 electrode 44, and a G6 electrode 46, spaced along the glass rods 32 in the order named. Each of the electrodes following the cathodes has three inline apertures therein to permit passage of three coplanar electron beams. The G1 grid electrode 36 and the G2 grid electrode 38 are parallel flat plates that can include embossings therein for added strength. Three inline apertures 48 (one shown) are located in the G1 grid electrode 36, and three apertures 54 (one shown) are located in the G2 grid electrode 38. The G3 electrode 40 is formed by the two cup-shaped elements 60 and 62, each having apertured bottoms The apertured bottom of the element 60 faces the G2 grid electrode 38, and the open end of the element 60 is attached to the open end of the element 62 The G4 electrode 42 is a plate having three apertures 61 (one shown) therein The G5 electrode 44 is formed by two cup-shaped elements 68 and 70. Each of the closed ends of the elements 68 and 70 includes three apertures, and the open ends of the elements 68 and 70 are connected. The G6 electrode 46 also includes two cup-shaped elements 72 and 73 having apertured bottoms. A shield cup 75 is attached to the outside bottom of the element 73.

The facing closed ends of the G5 electrode 44 and the G6 electrode 46, as shown in FIG. 3, have large recesses 76 and 78, respectively, therein The recesses 76 and 78 set back a portion of the closed end of the G5 electrode 44 that contains three apertures 82 from a portion of the closed end of the G6 electrode 46 that contains three apertures 88. The remaining portions of the closed ends of the G5 electrode 44 and the G6 electrode 46 form rims 92 and 94, respectively, that extend peripherally around the recesses 76 and 78. The rims 92 and 94 are the closest portions of the two electrodes 44 and 46 to each other. The configuration of the recess 78 in the G6 electrode 46 is different from that of the recess 76 in the G5 electrode 44. The recess 78 is narrower at the center aperture than at the side apertures, whereas the recess 76 is uniform in width at the three apertures therein.

The G4 electrode 42 is electrically connected to the G2 electrode 38 by a lead 96, and the G3 electrode 40 is electrically connected to the G5 electrode 44 by a lead 98, as shown in FIG. 3. Separate leads (not shown) connect the G3 electrode 40, the G2 electrode 38, the G1 electrode 36, the cathodes 34 and the cathode heaters to a base 100 (shown in FIG. 1) of the tube 10, so that these components can be electrically activated. Electrical activation of the G6 electrode 46 is obtained by a contact between the shield cup 75 and a conductive coating internal to the tube which is electrically connected to an anode button extending through the funnel 16.

In the electron gun 26, the cathodes 34, the G1 electrode 36 and the G2 electrode 38 comprise the beam-forming region of the gun. During tube operation, modulated control voltages are applied to the cathodes 34, the G1 electrode 36 is grounded, and a relatively low positive voltage (e.g., 800 to 1100 volts) is applied to the G2 electrode 38. The G3 electrode 40, the G4 electrode 42, and the facing portion of the G5 electrode 44 comprise a prefocusing lens portion of the electron gun 26. During tube operation, a focus voltage is applied to both the G3 electrode 40 and to the G5 electrode 44. The facing portions of the G5 electrode 44 and the G6 electrode 46 comprise the main focus lens of the electron gun 26. During tube operation, an anode voltage is applied to the G6 electrode 46 so that a bipotential focus lens is formed between the G5 and G6 electrodes.

Some typical dimensions for the electron gun 26 of FIG. 2 are presented in the following table.

TABLE

| | |
|---|---|
| External diameter of tube neck | 29.00 mm. |
| Internal diameter of tube neck | 24.00 mm. |
| Spacing between G1 and G2 electrodes | 0.18 mm. |
| Spacing between G2 and G3 electrodes | 1.19 mm. |
| Spacing between G3 and G4 electrodes | 1.27 mm. |
| Spacing between G4 and G5 electrodes | 1.27 mm. |
| Spacing between G5 and G6 electrodes | 1.27 mm. |
| Center-to-Center spacing between adjacent apertues in G5 electrode | 5.08 mm. |
| Diameter of Apertures in G5 and G6 electrodes | 4.06 mm. |
| Depth of recess in G5 electrode | 2.03 mm. |
| Thickness of G1 electrode | 0.10 mm. |
| Thickness of G2 electrode | 0.25 to 0.50 mm. |
| Thickness of G3 electrode | 7 mm. |
| Length of G4 electrode | 0.51 to 1.78 mm. |
| Length of G5 electrode | 17.22 mm. |
| Focus voltage | 7.8 to 9.5 kV |
| Anode voltage | 25 kV |

In the above-described electron gun 26, the G1 electrode 36, the G2 electrode 38 and the G4 electrode 42 are constructed of a material having a lower coefficient of thermal expansion, less than $10\times10^{-6}$° C.$^{-1}$, than do the materials used to construct the other electrodes. Preferably, the G1 electrode 36, the G2 electrode 38 and the G4 electrode 42 are made from 430 stainless steel, which is a magnetically permeable material having a coefficient of thermal expansion of about $9\times10^{-6}$° C.$^{-1}$. The bottom portion or G2-facing side of the G3 electrode 40 is made from a 52% nickel alloy which is also magnetically permeable and has a coefficient of thermal expansion of about $9.5\times10^{-6}$° C.$^{-1}$. The top portion of the G3 electrode 40, the G5 electrode 44 and the G6 electrode 46 are made from 305 stainless steel, which is nonmagnetic and has a coefficient of thermal expansion of about $20\times10^{-6}$° C.$^{-1}$. The purpose and results of using these materials of different coefficients of thermal expansion are discussed below.

Design Method

Figure 4:
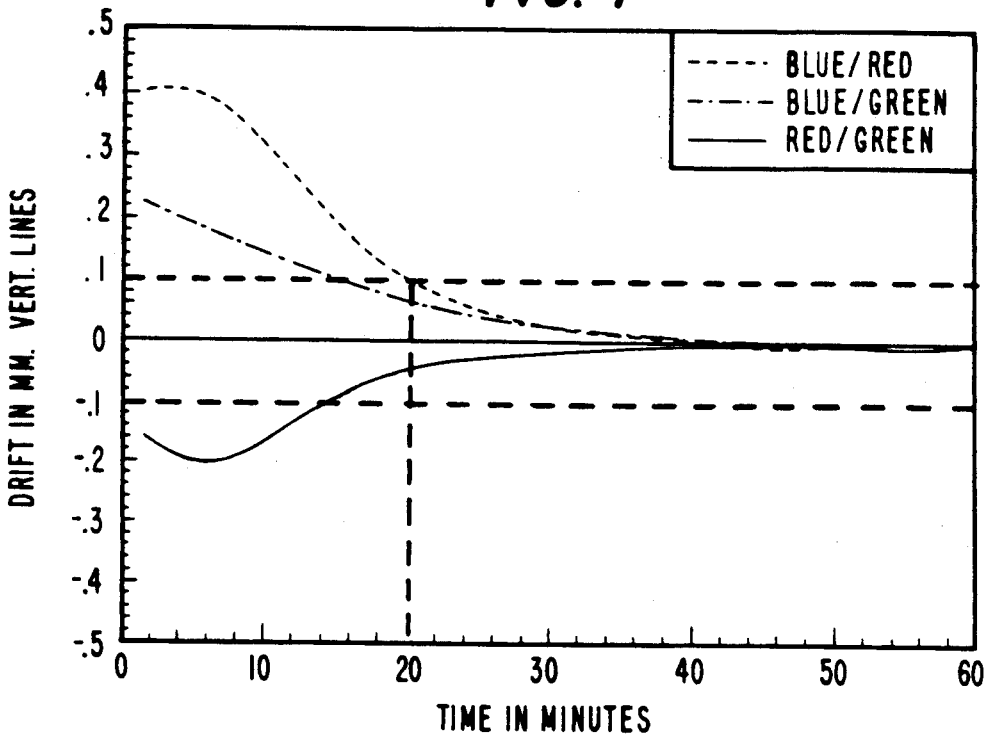
FIG. 4 is a graph showing convergence drift versus time for a standard unmodified electron gun of the type shown in FIG. 2.

The convergence drift of a standard unmodified electron gun of the same type as disclosed in FIG. 2 is shown in FIG. 4. The drift between the blue and red beams does not decrease to less than 0.1 mm until about 20 minutes. First, it is desirable to reduce the time that it takes for the convergence drift to decrease below 0.1 mm, but preferably, it is desirable to design an electron gun wherein the convergence drift never exceeds 0.1 mm.

The improved electron gun was designed by analyzing the motion of each electrode in the gun during tube warmup and then by determining the sensitivity of electron beam motion to the horizontal motion of the apertures in each electrode. Once this sensitivity was established, it then was determined how to alter the aperture motion of selected electrodes to reduce convergence drift through the use of different thermal expansion materials.

In doing the analysis, a computer program was used that simulated the electron beam trajectories. After the analysis, actual tubes were built and tested to verify the analytical results.

Electron Gun Analysis

Figure 5:
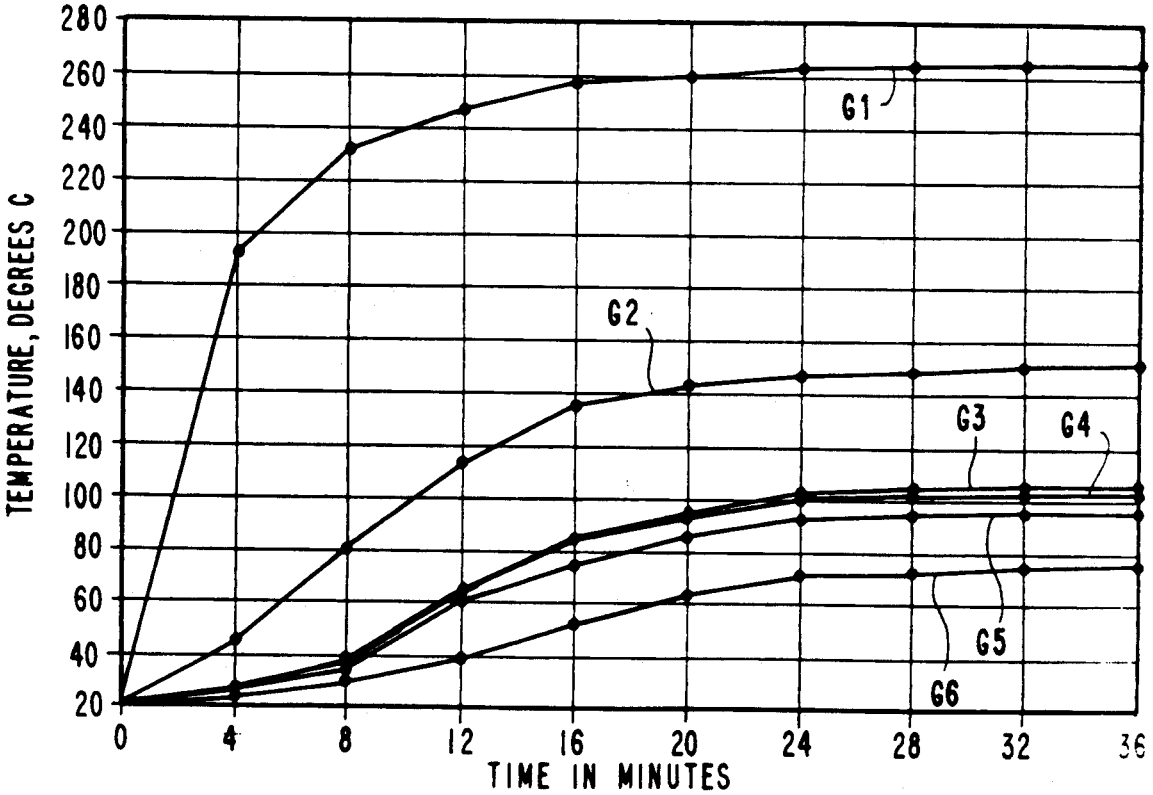
FIG. 5 is a graph of electrode temperature versus time during tube warmup.
Figure 6:
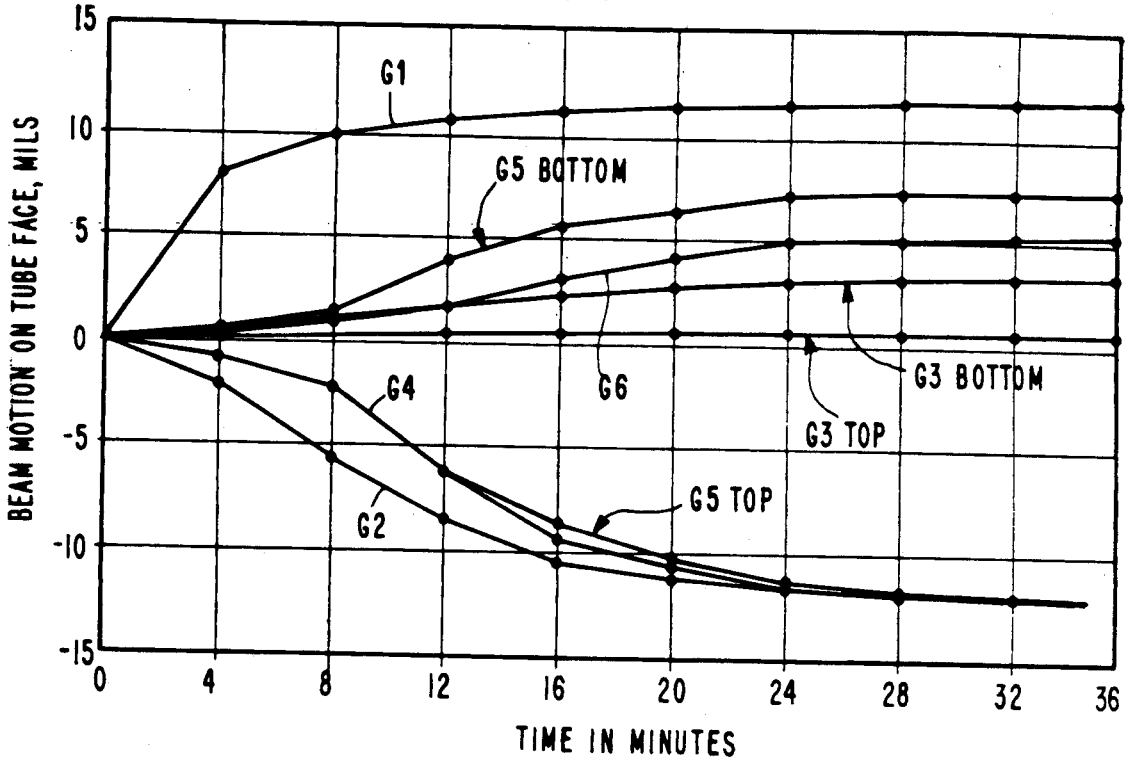
FIG. 6 is a graph of electron beam motion versus time for each electrode of the electron gun of FIG. 2.
Figure 7:
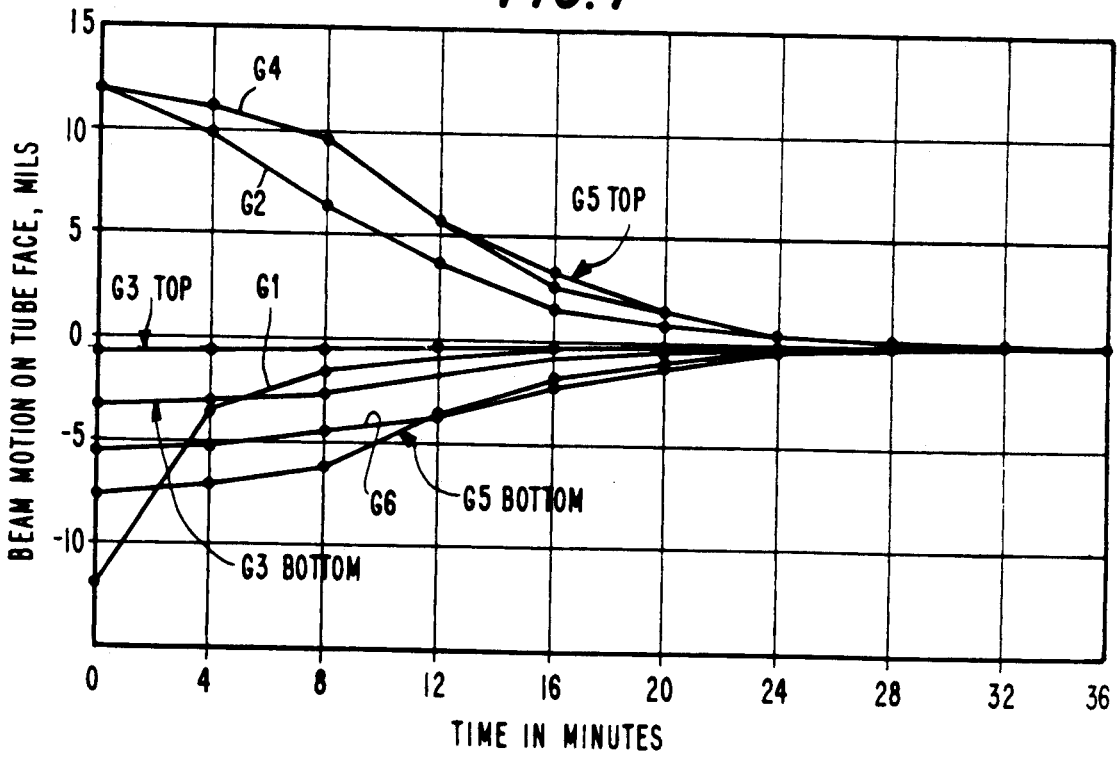
FIG. 7 is a graph, similar to the graph of FIG. 6, where the curves are normalized to converge at the end of the tube warmup time period.
Figure 8:
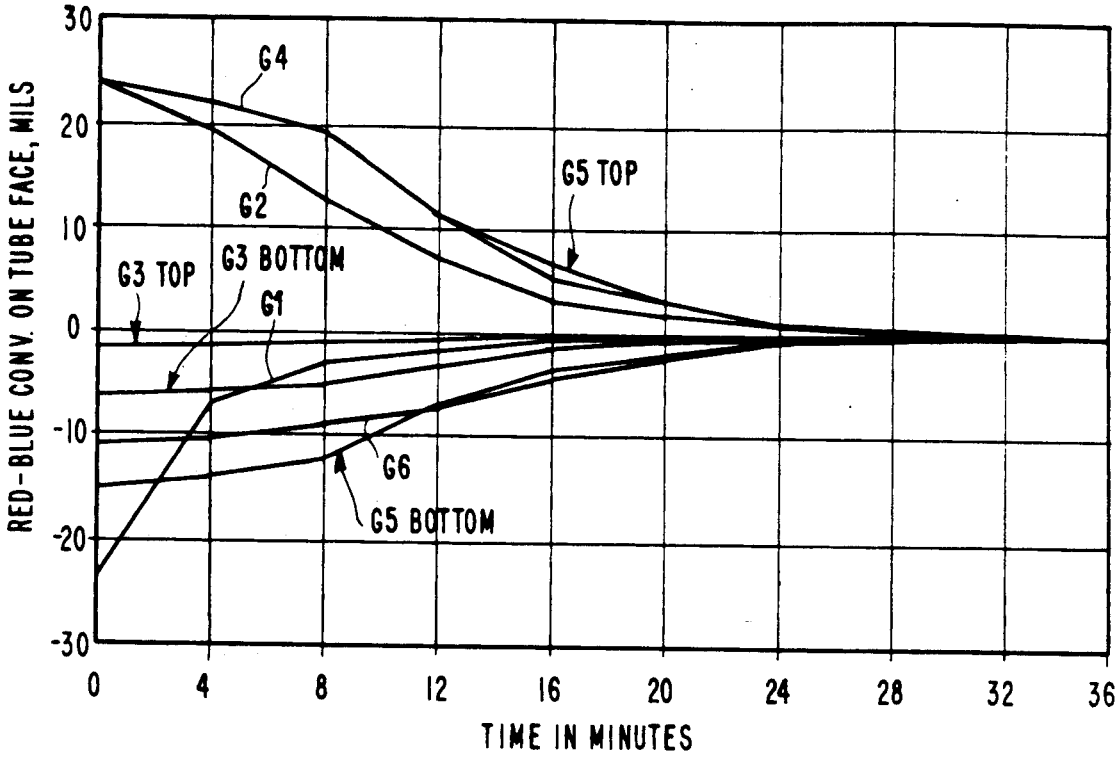
FIG. 8 is a graph, similar to the graph of FIG. 7, showing the convergence drift between two outer beams, red and blue.
Figure 9:
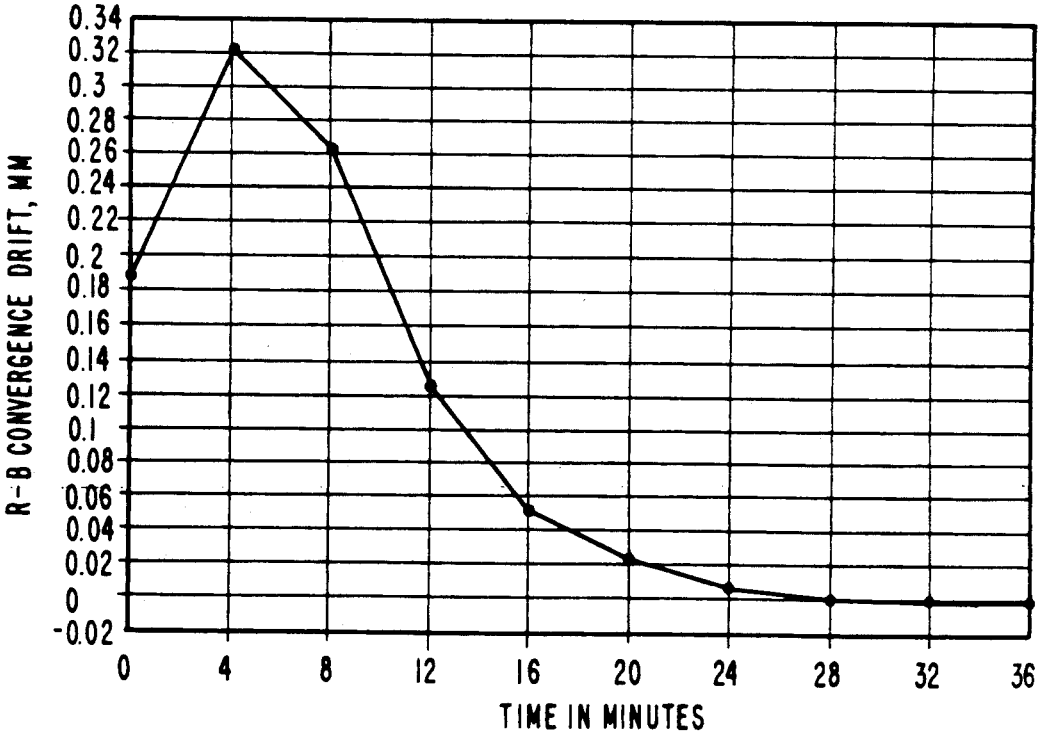
FIG. 9 is a graph showing the combined convergence drift between outer electron beams, red and blue, for all of the electron gun electrodes.

Utilizing the computer program, the horizontal positions of the outer apertures in each electrode were independently changed in 0.002 inch (0.05 mm) increments. From this, the sensitivity of electron beam motion at the screen to the aperture motion was determined for each electrode. The beam motion at the screen caused by the expansion of each electrode during tube warmup was then determined by translating the temperature rise of each electrode, as a function of time, into aperture motion, based on the thermal coefficient of expansion of the electrode material. Using the transient temperature rise of each electrode during warm-up, shown in FIG. 5, and the sensitivity of beam motion on the screen due to the 0.002 inch (0.05 mm) change in horizontal aperture position of each electrode, the beam motion on the screen for each electrode during warm-up was determined to be as shown in FIG. 6. By normalizing these curves to the steady-state converged beams, as shown in FIG. 7, the contribution to convergence drift of each electrode can be seen. Because the two outer beams (red/blue) have equal but opposite motion during warm-up, the red-to-blue convergence drift is twice that of a single beam, as shown in FIG. 8. Summing the contributions of each grid at specific times resulted in the theoretical red-to-blue convergence drift shown in FIG. 9.

Figure 10:
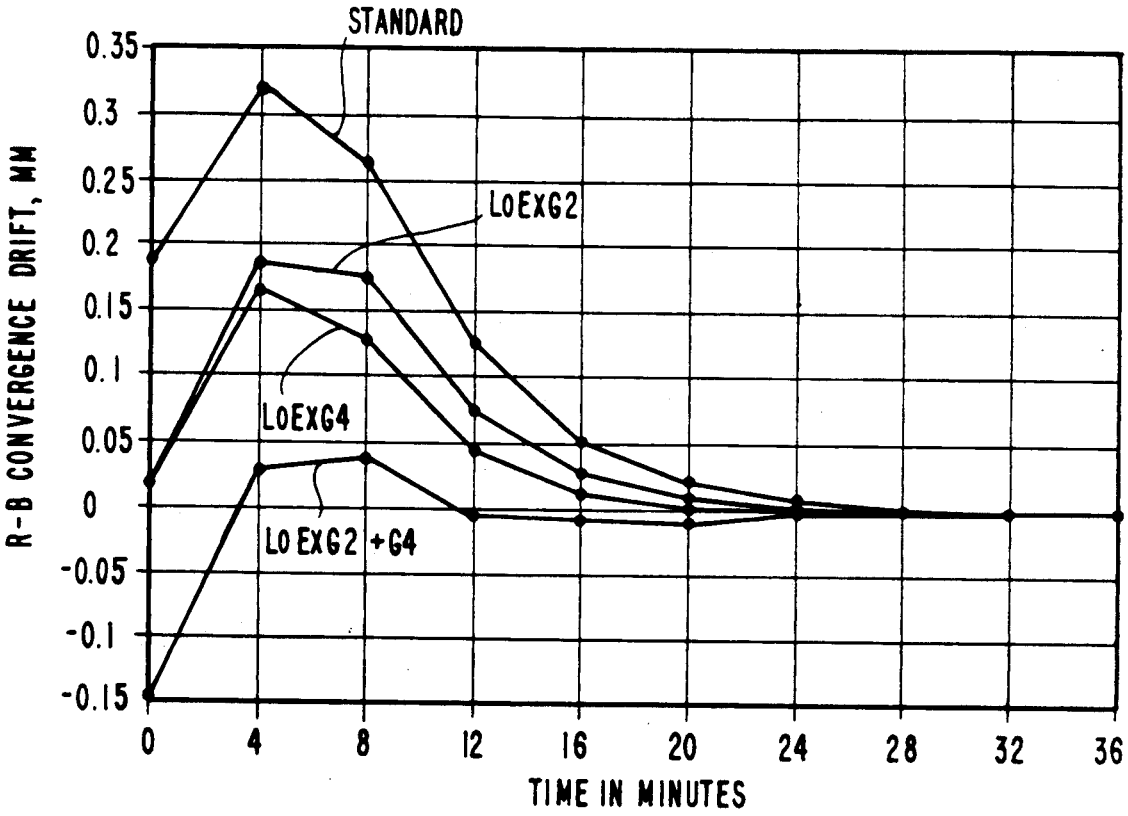
FIG. 10 is a graph of the combined convergence drift between outer electron beams for a standard unmodified electron gun, a gun with a low expansion G2 electrode, a gun with a low expansion G4 electrode and a gun with combined low expansion G2 and G4 electrodes.
Figure 11A:
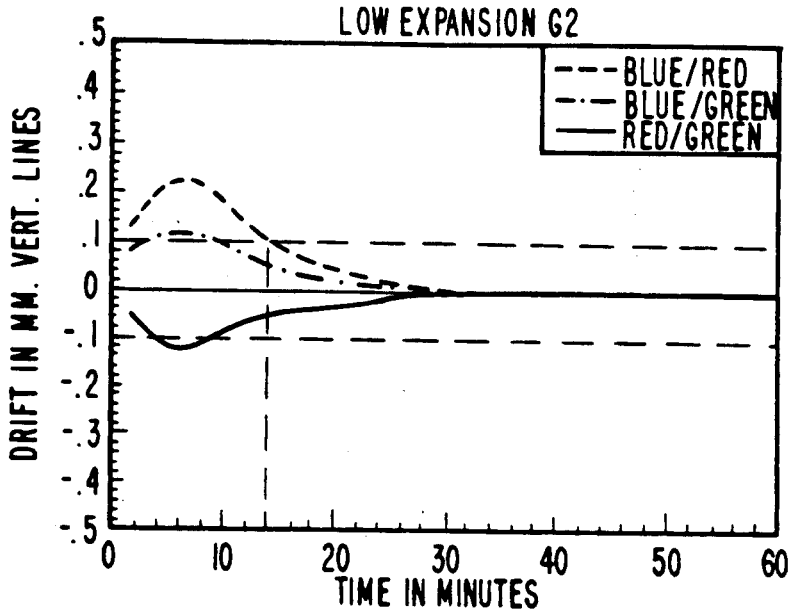
FIGS. 11*a*, 11*b* and 11*c* are graphs of convergence drift curves for three different tubes having low expansion G2 electrodes.
Figure 11B:
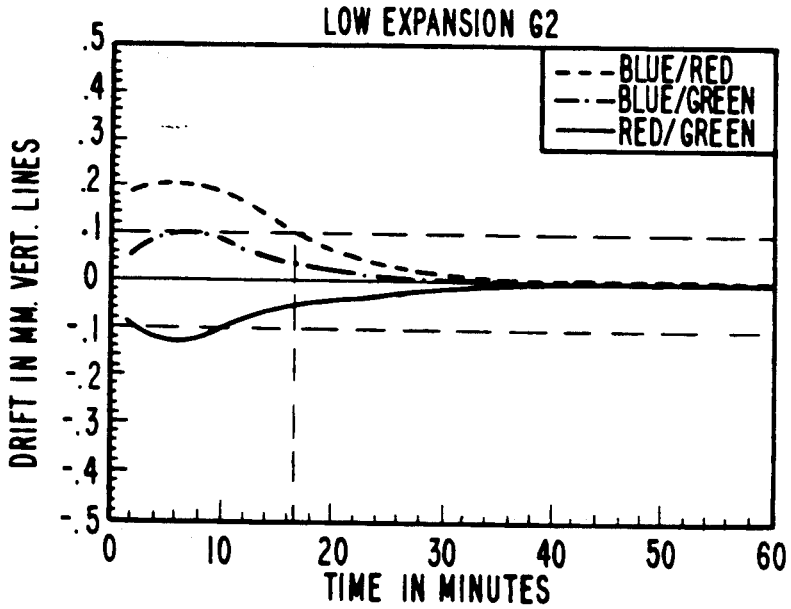
Figure 11C:
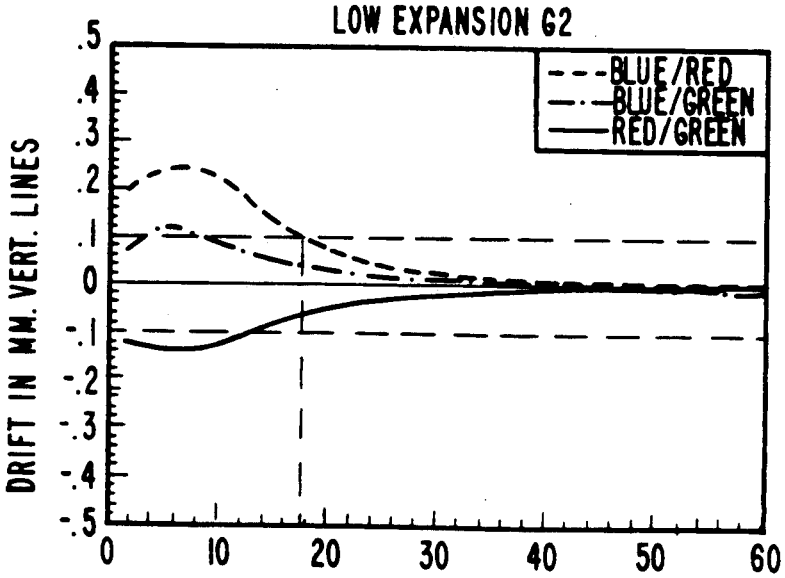
Figure 12A:
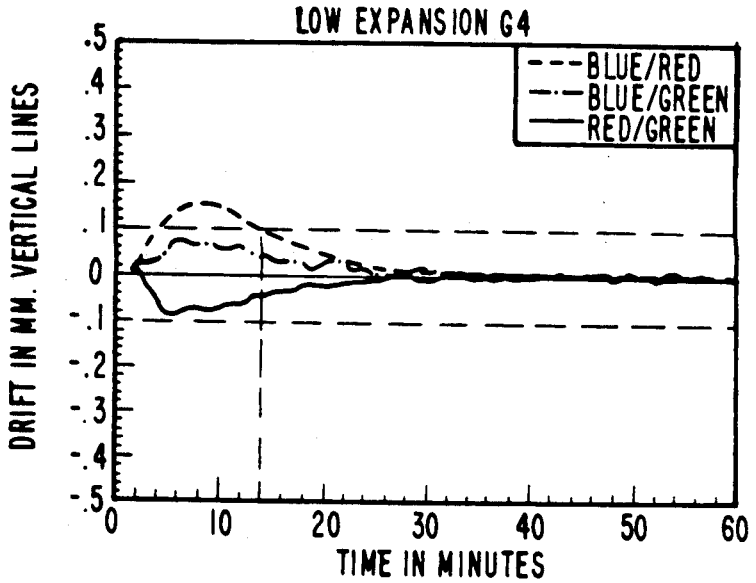
FIGS. 12*a*, 12*b* and 12*c* are graphs of convergence drift curves for three different tubes having low expansion G4 electrodes.
Figure 12B:
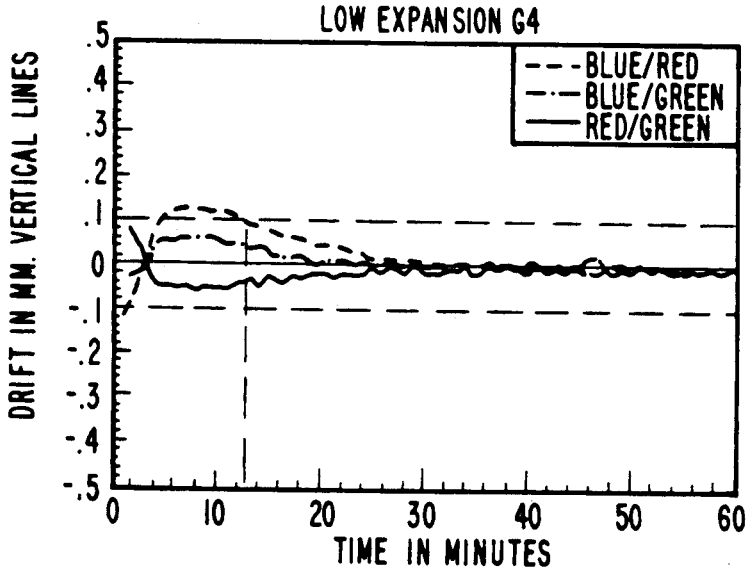
Figure 12C:
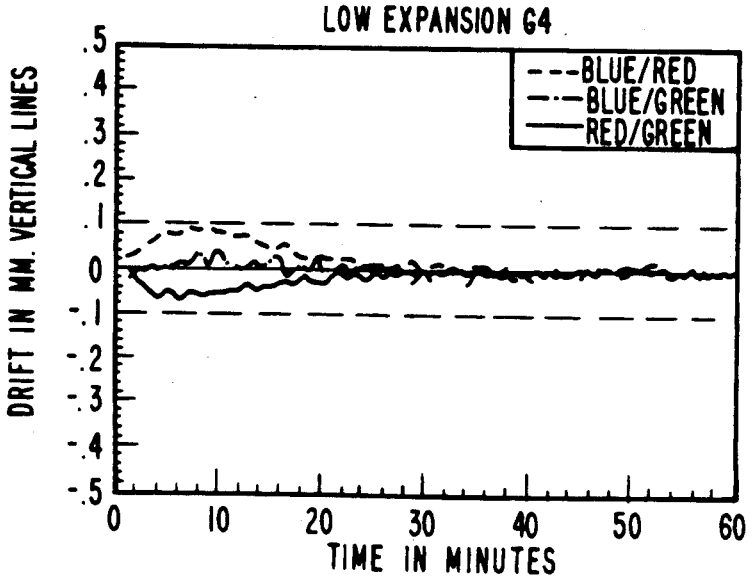
Figure 13A:
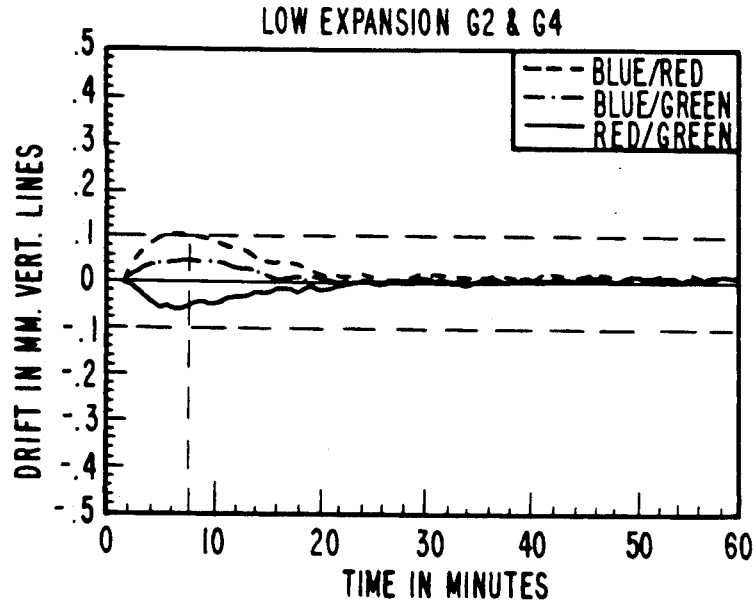
FIGS. 13*a*, 13*b* and 13*c* are graphs of convergence drift curves for three different tubes having combined low expansion G2 and G4 electrodes.
Figure 13B:
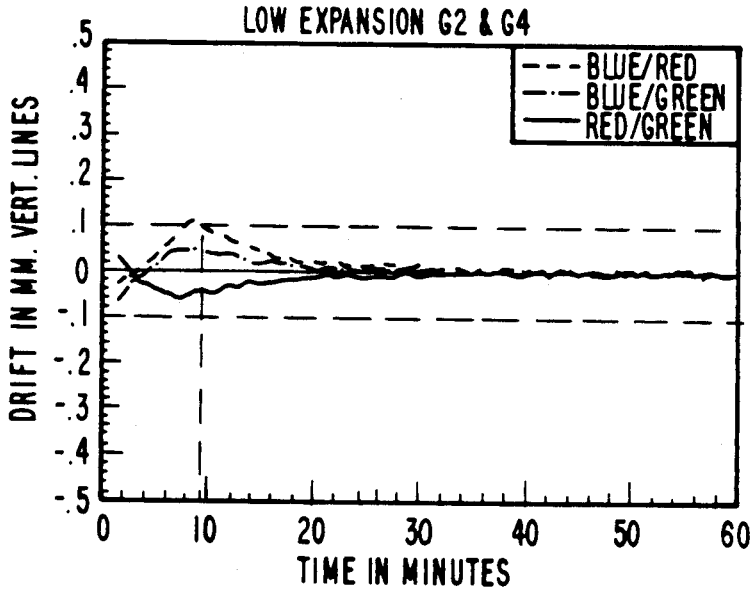
Figure 13C:
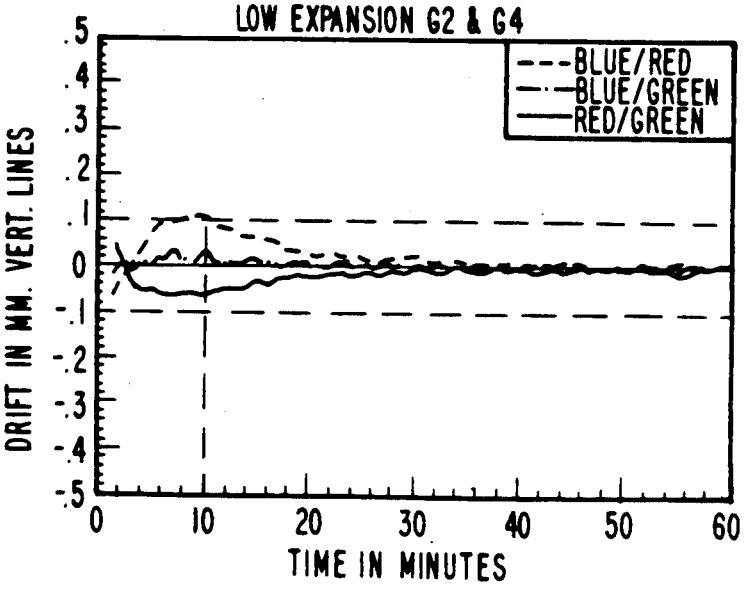

Since the net peak convergence drift is +0.32 mm (FIG. 9), convergence drift can be reduced by reducing positive beam motion components. Referring to FIG. 8, this was achieved by making the G2 and G4 electrodes from materials having substantially lower coefficients of thermal expansion than the thermal expansion coefficients of the G5 and G6 electrode materials, e.g., about $9\times10^{-6}$ ° C.$^{-1}$ versus about $20\times10^{-6}$° C.$^{-1}$. The theoretical results of using only a low expansion G2, only a low expansion G4, and both a low expansion G2 and G4 (compared to a standard electron gun having 305 stainless steel G2 and G4 electrodes) are shown in FIG. 10. From this figure, it can be seen that the increasing order of improvement is, as expected, with the low expansion G2, then the low expansion G4, and then the combination low expansion G2 and G4. With the combination low expansion G2 and G4, settling of the convergence drift to within 0.1 mm of the steady-state convergence value occurs within 1.5 minutes, as compared to 13 minutes for the standard electron gun.

It is to be noted that convergence drift could also have been improved by using a low expansion G5 top in place of the low expansion G4 (See FIG. 8). However, this would not be desirable, because low expansion materials are usually magnetic The G5 is located in the tube such that, if it were magnetic, it would render other components, such as external beam benders on the neck, less effective and would increase yoke drive requirements.

The bottom portion or G2-facing side of the G3 is made of a magnetically permeable material, to act as a shield to prevent penetration of the deflection fields into the beam-forming region of the electron gun. Such magnetically permeable materials have lower coefficients of thermal expansion and are used, even though the electron gun analysis indicates that a higher coefficient of thermal expansion material would be preferable from the beam convergence standpoint.

Similarly, the G1 is constructed of a low expansion material, even though the analysis indicates that a higher expansion material should be used, because of its close proximity to the cathodes. Large expansion of the G1 may cause it to warp, because it is a thin flat electrode.

Experimental Results

Figure 14:
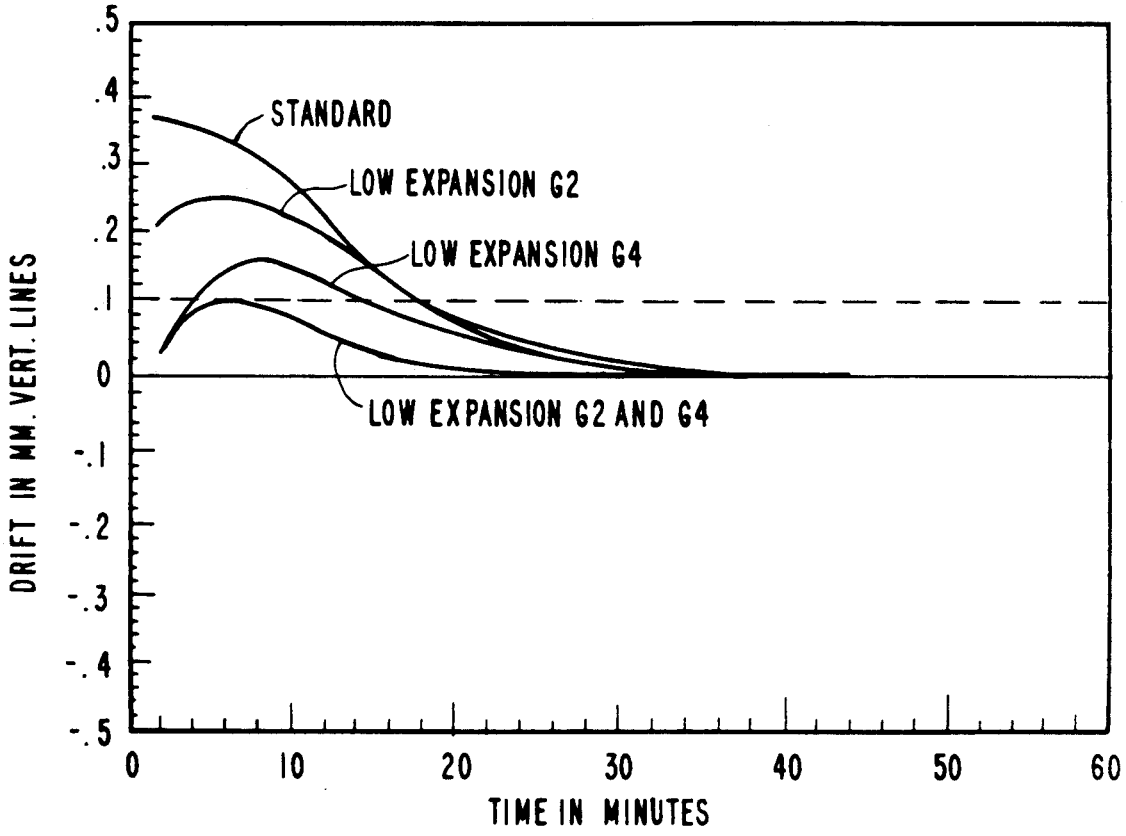
FIG. 14 is a composite graph comparing the outer-to-outer beam convergence drift for tubes having a standard unmodified gun, a gun with a low expansion G2, a gun with a low expansion G4 and a gun with combined low expansion G2 and G4 electrodes.

Based on the theoretical analysis of red-to-blue convergence drift in the electron gun, three guns were fabricated having low expansion G2 electrodes, three guns were fabricated with low expansion G4 electrodes, and three guns were fabricated having both low expansion G2 and G4 electrodes, e.g., about $9\times10^{-6}$° C.$^{-1}$. The convergence drift results of these electron gun configurations are shown in FIGS. 11*a–c* 12*a–c* and 13*a–c*, respectively. A comparative summary of the standard and the modified guns, of FIGS. 11*a–c*, 12*a–c* and 13*a–c*, is shown in FIG. 14. As seen in FIG. 14, the relative convergence drift performance of the experimental tubes is the same as that calculated in the theoretical analysis for low expansion G2 and G4 electrodes. The time to settle within 0.1 mm of the steady-state convergence is less than 2 minutes, as compared to 18 minutes for the standard gun.

Although the above method, of determining which electrode or electrodes of an electron gun should be constructed of a material having a lower coefficient of thermal expansion, was described for an electron gun having six electrodes and particular electrical connections, the method also may be applied to other electron guns having different numbers of electrodes and different electrical connections.

What is claimed is:

1. In a color picture tube including a screen and an inline electron gun for generating and directing three inline electron beams along separate paths toward said screen, said electron gun comprising a plurality of cathodes and at least six electrodes longitudinally spaced from said cathodes, the improvement comprising the first, second and fourth electrodes from said cathodes being of materials having lower coefficients of thermal expansion than the coefficients of thermal expansion of the materials of the other electrodes.

2. The tube as defined in claim 1 wherein said second and fourth electrodes from said cathodes are electrically connected.

3. The tube as defined in claim 2 wherein a third electrode from said cathodes is electrically connected to a fifth electrode from said cathodes.

4. The tube as defined in claim 1 wherein the first, second and fourth electrodes from said cathodes are of magnetically permeable materials and at least two of the other electrodes ar of nonmagnetic materials.

5. In a color picture tube including a screen and an inline electron gun for generating and directing three inline electron beams along separate paths toward said screen, said electron gun comprising three inline cathodes and six electrodes longitudinally spaced from said cathodes, the second and fourth electrodes from said cathodes being electrically connected and the third and fifth electrodes from said cathodes being electrically connected, the improvement comprising the first, second and fourth electrodes from said cathodes being of a material having a coefficient of thermal expansion of about $9\times10^{-6}$° C.$^{-1}$, and the remaining electrodes being of materials having higher coefficients of thermal expansion.

6. The tube as defined in claim 5, wherein at least a portion of the third electrode from said cathodes is of a material having a coefficient of thermal expansion of about $9.5\times10^{-6}$° C.$^{-1}$.

7. The tube as defined in claim 5 wherein at least a portion of the third electrode from said cathodes is of a material having a coefficient of thermal expansion of about $20\times10^{-6}$° C.$^{-1}$.

8. The tube as defined in claim 5 wherein the fifth and sixth electrodes from said cathodes are of materials having a coefficient of thermal expansion of about $20\times10^{-6}$° C.$^{-1}$.

9. The tube as defined in claim 8 wherein a portion of the third electrode from said cathodes that faces the second electrode is of a material having a coefficient of thermal expansion of about $9.5\times10^{-6}$° C.$^{-1}$.

10. The tube as defined in claim 9 wherein a portion of the third electrode from said cathodes that faces the fourth electrode is of a material having a coefficient of thermal expansion of about $20\times10^{-6}$° C.$^{-1}$.

* * * * *